United States Patent [19]

Leivenzon et al.

[11] 4,449,562

[45] May 22, 1984

[54] MULLION SECTION MEMBER

[75] Inventors: Simon Leivenzon; Steven Leivenzon, both of Caulfield, Australia

[73] Assignee: Firmagroup Australia Pty. Ltd., Cheltenham, Australia

[21] Appl. No.: 278,219

[22] Filed: Jun. 26, 1981

Related U.S. Application Data

[63] Continuation-in-part of Ser. No. 250,253, Apr. 2, 1981, abandoned, which is a continuation of Ser. No. 83,650, Oct. 11, 1979, abandoned.

[51] Int. Cl.[3] ..... E06B 3/48

[52] U.S. Cl. ..... 160/113

[58] Field of Search ..... 160/113, 118, 119; 49/365; 292/175

[56] References Cited

U.S. PATENT DOCUMENTS

| | | | |
|---|---|---|---|
| 907,525 | 12/1908 | Rapson | 292/175 |
| 1,784,948 | 12/1930 | Rush | 49/365 |
| 2,275,730 | 3/1942 | Casse | 49/365 |
| 2,309,436 | 1/1943 | Blodgett | 49/365 |
| 3,078,917 | 2/1963 | Recchione | 160/113 |
| 3,191,549 | 6/1965 | Adler | 160/113 |
| 3,265,015 | 8/1966 | Adler | 49/365 |
| 3,672,098 | 6/1972 | Webb et al. | 49/365 |

*Primary Examiner*—Peter M. Caun

*Attorney, Agent, or Firm*—Abelman, Frayne, Rezac & Schwab

[57] ABSTRACT

A mullion section member is disclosed for fitting between a pair of adjacent roller shutter doors in a door opening. The mullion section member is of a suitable length, has opposed channels at opposite sides each for slidably receiving the edge of the curtain of a respective roller shutter door. A portion bridges the two channels, and behind said portion on the inside face of the mullion section member, there is provided flange means defining a recess between said flange means and said portion, in which a plate-like tongue member is slidably received to slide longitudinally of the length of the mullion section member. This permits the releasable fastening thereof to a similar mullion section member fastened relative to said door opening. The tongue member has a cut-out at one side which is hidden by said flange means. The recess associated with said flange means which hides said cut-out has a stop means therein which is so positioned along the length of said mullion section member that it is received in said cut-out and limits the extent by which said tongue member can be extended from one end of said mullion section member. This enables the tongue member 19 to locate in recesses of a said mullion section member fixed relative to said door opening. The stop means limits the extent by which said tongue member can be retracted inwardly into said mullion section member.

7 Claims, 8 Drawing Figures

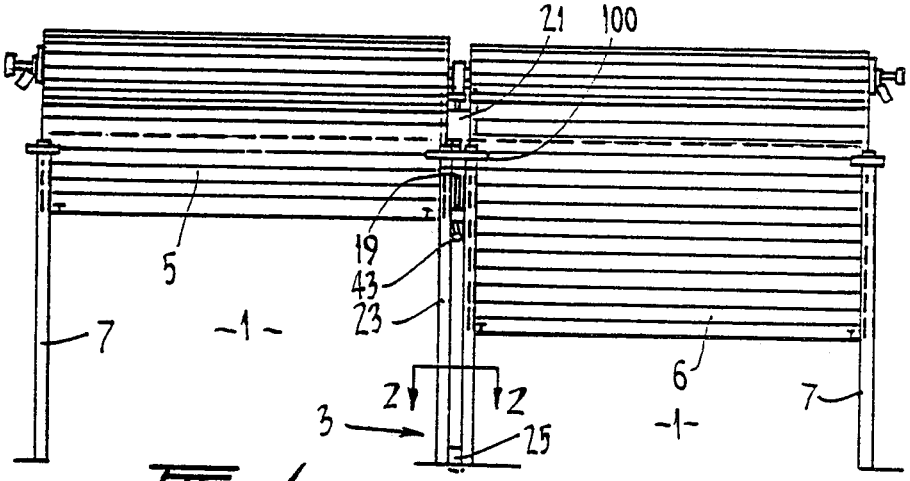
FIG. 1.
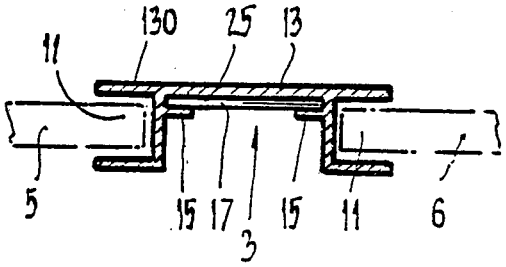
FIG. 2.
FIG. 3.
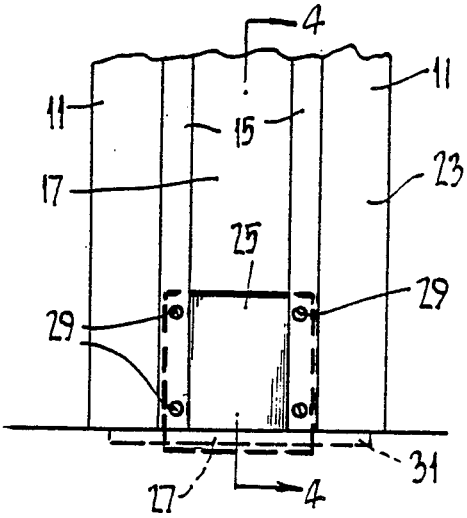
FIG. 4.
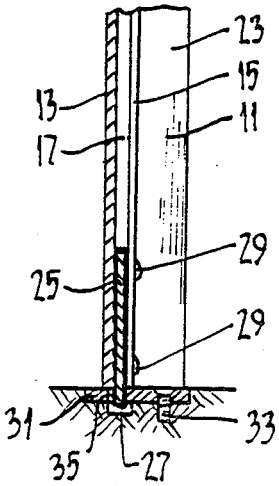

MULLION SECTION MEMBER

CROSS REFERENCES TO RELATED APPLICATIONS

The application is a continuation-in-part of U.S. patent application Ser. No. 250,253 filed Apr. 2, 1981, now abandoned, which is a Rule 60 continuation application of U.S. patent application Ser. No. 083,650, filed Oct. 11, 1979, also now abandoned.

FIELD OF THE INVENTION

This invention relates to a mullion section member and an assembly and relates particularly to such for use in connection with adjacent roller shutter doors in a doorway.

STATEMENT OF PRIOR ART

Hitherto in the roller shutter door art where two roller shutter doors are placed side by side it has been common practice to provide a removable mullion member between the two roller shutter doors. A problem with such prior art Mullions was that in order to fasten the mullion member to the floor and to the top of the door opening it was necessary to provide mounting bracket means which were held to the mullion section member by bolts which pass through the outer face of the mullion section member. The mounting bracket means, in turn, carried two fastening means which engaged respectively with the top and the bottom of the door opening. One or both of the fastening means was releasable so that the mullion could be removed. In the prior art the heads of the bolts are very unsightly on the front face of the mullion and additionally the fastening means is not entirely satisfactory.

SUMMARY OF THE INVENTION

Accordingly the present invention has been devised with the object of providing an improved mullion section member whereby fastening can be made without boltheads or the like being visible from the outside of the door opening and whereby a better releasable connection can be made to the top and bottom of the door opening.

According to one aspect of the invention there is provided a mullion section member for fitting between a pair of adjacent roller shutter doors in a door opening, said mullion section member being of a suitable length and having opposed channels at opposite sides each for slidably receiving the edge of the curtain of a respective roller shutter door, a portion bridging the two channels, and behind said portion on the inside face of the mullion section member flange means defining a recess between said flange means and said portion, in which a plate-like tongue member is slidably received to slide longitudinally of the length of the mullion section member, means fastened to said flange means slidably securing said tongue in said recess at one end of the mullion section member.

According to another aspect of the present invention there may be provided a mullion section member assembly for fitting between a pair of adjacent roller shutter doors in a door opening, said mullion section member assembly comprising two substantially identical cross section pieces, one piece being for fixing at the door opening so as to extend downwardly from the top of the opening, the other piece being of a length to fill the space between the bottom of said one piece and the floor, of the door opening cross-section of the mullion pieces having opposed channels at opposite sides each of a size for slidably receiving the edge of a curtain of a respective roller shutter door, a portion bridging the two channels, and behind said portion, on the inside face of the mullion section member, flange means defining a recess between said flange means and said portion, in which a plate-like tongue member can be slidably received to slide in direction along the length of the mullion section member, means fastened to said flange means in said other piece slidably securing said tongue in said recess at the top thereof, locating means extending from the bottom of said other piece, all arranged whereby to enable said other piece to be removably fastened to said one piece and in the position in the door opening by engaging the locating means at the bottom of said other piece with fastening means on the floor and then by sliding the tongue into the corresponding recess in said one piece.

Most preferably there is a mounting bracket for supporting axles of the adjacent roller shutter doors, in said channels, in said one piece, and retained thereto in desired position by fastening means fastened to said flange means.

BRIEF DESCRIPTION OF DRAWINGS

FIG. 1 is a rear view of a door opening fitted with two adjacent roller shutter doors with a mullion section member assembly therebetween.

FIG. 2 is a cross-sectional view taken along the line 2—2 of FIG. 1 showing the detail of the mullion section member.

FIG. 3 is a rear view showing detail of locating and fastening means at the bottom of the mullion section member for holding it to a floor.

FIG. 4 a side view of the view shown in FIG. 3 taken along the line 4—4 therein.

DETAILED DESCRIPTION OF PREFERRED EMBODIMENTS

Figure 5:
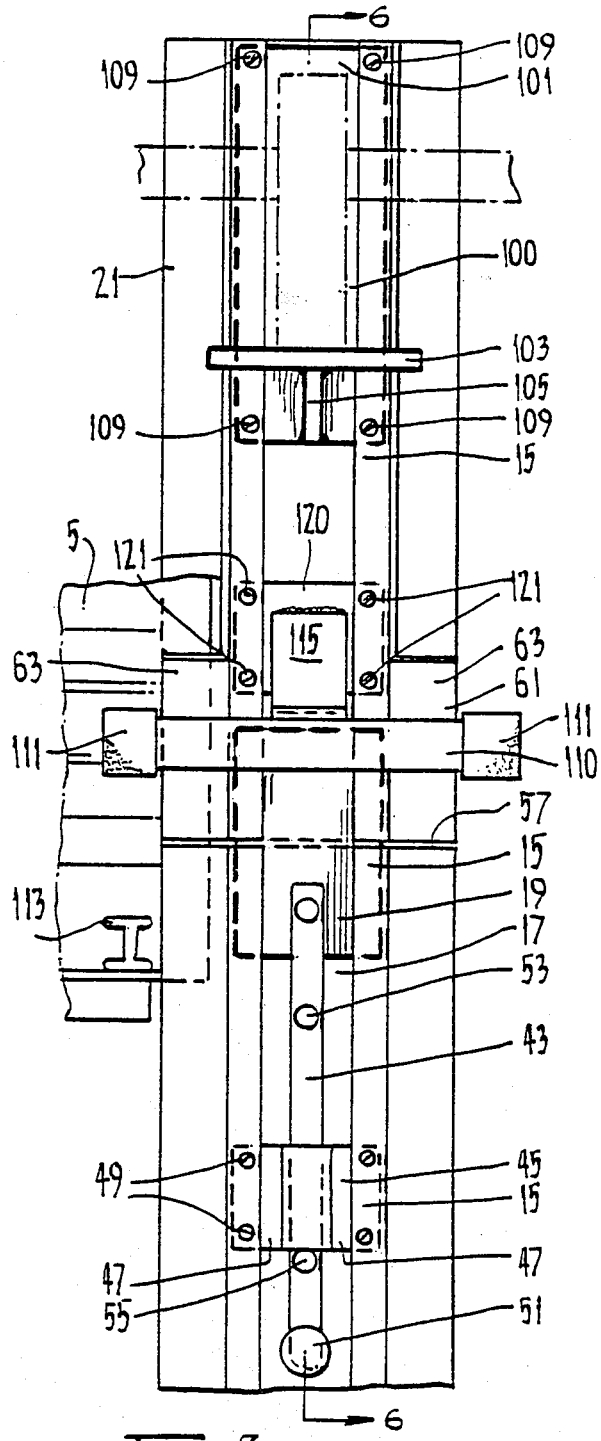
FIG. 5 is a close-up detail of the mullion section member and tongue means therein for engaging said one portion.

Referring firstly to FIG. 1 there is shown a door opening 1 and a mullion section member assembly 3 therebetween. Two roller shuttered doors 5 and 6 bridge the door opening 1. Door frame means 7 are provided on each side of the opening for slidably receiving the outer sides of the curtains of the roller shutter doors 5 and 6. The mullion section of the mullion section assembly 3 is shown in FIG. 2 and comprises opposed channels 11 in which the edges of the curtains of the roller shuttered doors 5 and 6 are received. The mullion section member has a portion 13 bridging the two channels 11 and behind said portion 13 on the inside face of the mullion section member are two flange means 15 which define a recess 17 between said flange means 15 and the bridging portion 13. The recess 17 receives a tongue member 19 so it can slide in a direction along the length of the mullion section member in the recess 17. The tongue 19 will be referred to later.

The mullion section member assembly 3 includes one piece 21 for fixing at the door opening 1 so as to extend downwardly from the top of the opening 1. The piece 21 can be of any desired length provided it has sufficient length to enable its upper-most end to be fastened to frame means surrounding the opening 1 such as by bolts passing into brickwork or the like or alternatively by being bolted directly onto the frame 7 which can be brought around to extend across the top of the opening 1. The other piece 23 of the mullion section member assembly 3 is desirably made of a standard length such as 7'6", which is the usual opening height of a doorway. The position of the one piece 21 is selected to be fastened so that the piece 23 can fit neatly thereunder and centrally between the doors 5 and 6.

Referring now to FIGS. 3 and 4 there is shown a means whereby the lower end of section 23 can be fastened to the floor. A plate member 25 of the width equal to the width between the recess 17 and of a thickness equal to the depth of the recess 17 is screwed to the bottom of the section 23 so that a portion 27 extends below the bottom of the section 23. The plate 25 is screwed to the section 23 by screws 29 which pass through the flanges 15 and screw into the plate 25. A further plate 31 is embedded into the floor and held thereto by bolts 33 in the floor. The plate 31 has a slot 35 therein in which the portion 27 of the plate 25 can be received.

Figure 6:
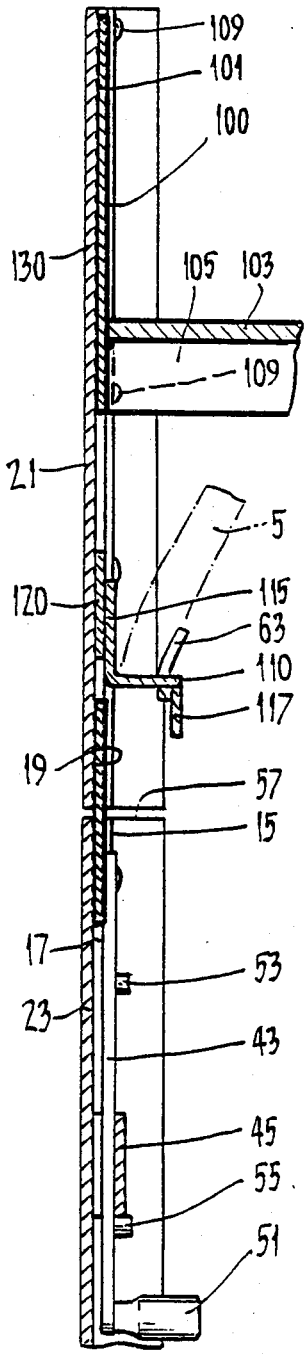
FIG. 6 is a side cross-sectional view taken along the lines 6—6 of FIG. 5.

The tongue 19 which is slidably received in the recess 17 is made from a piece of steel plate of a width equal to the width between the channels 11 and of a thickness equal to the depth of the recess 17. The tongue 19 is fastened to a bolt 43 which is slidably retained to the section 23 by a retaining member 45 which has a generally "top hat" sectional shape. The side flanges 47 of retaining member 45 locate underneath flanges 15 in the recess 17. Screws 49 hold the retaining member 45 to the section 23 by passing through the flanges 15 and screw into the flanges 47. The bolt 43 has a handle 51 thereon for enabling manual movement of the tongue 19 up and down the recess 17 within limits defined by stops 53 and 55 provided in the position shown on the bolt 43 in FIGS. 5 and 6. The tongue 19 is in the extended position so that it extends past the top 57 of the section 23. Thus by inspecting FIGS. 5 and 6 it can be seen that in this position the tongue 19 extends into the corresponding mating recess 17 in the section 21 thus holding section 23 in place between the two doors 5 and 6. The rearward most flanges 61 which define part of the opposed channels 11 are cut, in the section 21, at regions 63 and bent rearwardly as shown in FIG. 6 so as to provide for a smooth entry of the curtain of the doors 5 and 6 into the channels 11.

Thus, to remove the mullion section 23 from between the doors 5 and 6 the doors 5 and 6 are both raised fully, bolt 43 is moved downwardly retracting the tongue 19 from the recess 17 in the section 21. The mullion section 23 is then swung either forwardly or backwardly and lifted so that the lower tongue 25 is removed from the slot 35 in the floor.

A mounting bracket 100 for mounting axle supports of the roller shutter doors 5 and 6 is fastened to the portion 21 at the required height. Two mounting brackets 100 may be provided one above the other if the heights of the roller shutter doors 5 and 6 are respectively at different floor heights. In each case the mounting brackets 100 may be of identical construction. The mounting brackets 100 comprise a plate member 101 which neatly slidably fits into the recess 17 so as it can slide longitudinally up and down the length of section 21. The plate 101 has a right-angle arm 103 extending therefrom which is suitably braced by webs 105. The arm 103 has a width which enables it to pass between the opposed channels 11 and between the flanges 15. It then swells outwardly to a greater width at its free end to provide a sufficient width for mounting of the axles thereto. The mounting bracket 100 is secured to the section 21 by bolts 109 which pass through the flanges 15 and are screwed into the plate 101.

A stop 110 for the roller shutter doors 5 and 6 is provided on the section 21. The stop 110 has buffers 111 at each side thereof which extend past the sides of the mullion section 21 so as to locate with lugs 113 which are an integral part of the bottom of the roller shutter doors 5 and 6. The stop 110 is fitted to the section 21 by an angle bracket 115 with a downturned rear portion 117. A bracket 115 connects with a plate 120 which in turn is of a size to be slidably received in the recess 17 in the same manner as the supporting bracket 100 and the tongue 19. The plate 120 is in turn fastened to the section 21 by bolts 121 which pass through the flanges 15 and screw into the plate 120.

It will be appreciated that the front face 130 of the mullion section member assembly 3 can have decorative grooves or protrudences moulded thereon. Desirably the mullion section members 21 and 23 are made from an extruded aluminium section.

Figure 7:
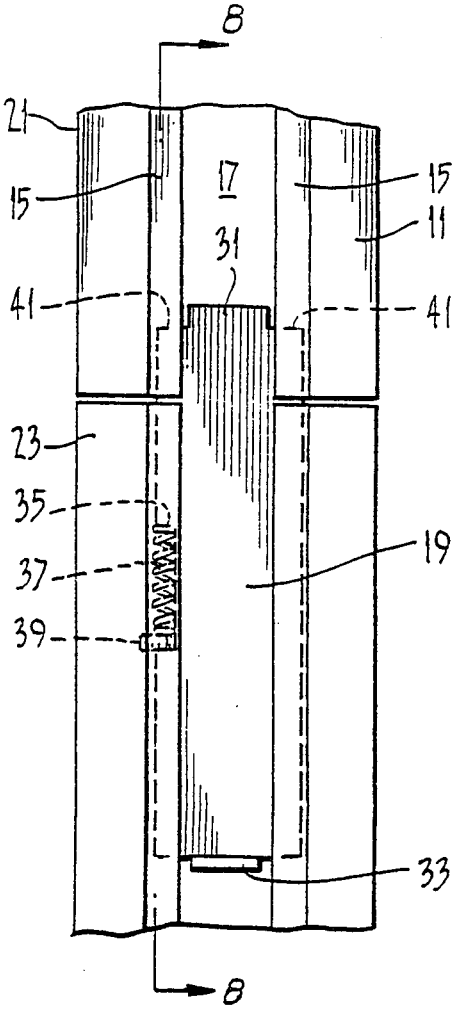
FIG. 7 is a close-up detail of the mullion section member with an alternative construction of tongue means.
Figure 8:
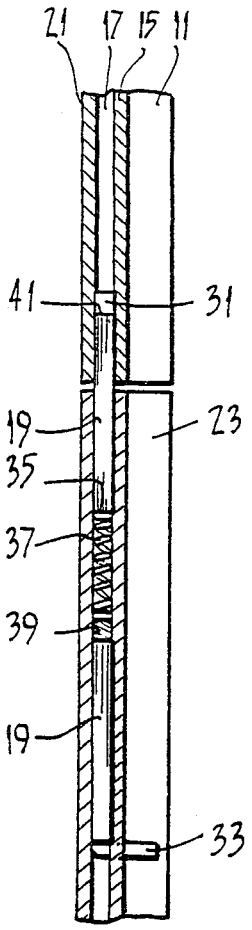
FIG. 8 is a cross sectional view taken along line 8—8 of FIG. 7.

A modification of the tongue 19' is shown in FIGS. 7 and 8.

The modified tongue 19' is slidably received in the recess 17 and is made from a piece of metal such as aluminium or steel plate of a width equal to the width between the channels 11 and of a thickness substantially equal to the depth of the recess 17 so that it can slide therein along the length of the mullion section.

The tongue 19' has a stepped upper portion 31 of a width just narrower than the width between the sides of flanges 15 and it has a hand gripping portion 33 at its lower end. The portion 33 is made by bending a plannar blank of the tongue 19' so that it extends at right angles from the plane of the major part of the tongue 19'.

The tongue 19' also has a cut-out 35 at one side thereof. The cut-out 35 is marginally longer in length than the intended distance that the tongue 19' is to extend past the end of the piece 23 and of a depth sufficient to hold a compression spring 37 therein. The compression spring 37 bears against the upper end of the cut-out 35 at one end and against a retaining screw 39 screw threaded into the recess 17 through one side of the channels 11 (see FIGS. 2, 7 and 8) of piece 23. Thus the spring 37 acts by its bias to push the tongue 19' outwardly from the end of the piece 23. The dimensioning of the cut-out 35 and the overall length of the spring 37, when compressed and the diameter of the grub screw 39 are such that when the tongue 19' is fully retracted, the shoulders 41 of the stepped portion 31 are flush with the top of the piece 23 thus leaving the stepped portion 31 exposed. Therefore, when in this position the portion 31 is in the recesses 17 of piece 21 and can be removed therefrom by merely swinging piece 23 away from piece 21. If the tongue 19' is released by an operator then it will extend to the position shown in FIGS. 7 and 8 by the action of the spring 37 and thus it will secure the piece 23 to piece 21 as the tongue 19' will then be positively located behind the flanges 15 of portion 21.

It will be appreciated that the mullion section member described herein provides an easy 'on site' installation as in the construction proposed herein, if the door opening height is not precisely the same as the mullion section piece 23 (- 7'6"-), then that piece 23 can be simply cut to the required length—preferably at the bottom—and the plate member 25 refitted. This does not require special tools or skills by the installer.

Similarly, the exact locating position of the mounting brackets 100 may be correctly positioned, on-site, so that the axles of each of the roller shutter doors are correctly positioned in height relative to the floor and then the plate member 101 fastened at the correct position by the screws 109 passing through suitable holes which may then be drilled on-site in the flanges 15.

Further the stops 110 can be suitably positioned on-site by sliding the plate means 120 along the recess 17 to the required position and then the plate means 120 fastened to the flanges 15 by the screws 121 passing through suitable holes which may then be drilled on-site in the flanges 15.

Thus the height adjustments of various components of the assembly can be made on-site with just a drill and without the use of special tools or welding equipment.

In each case the components of the assembly which are slidably received in the recess 17 are pre-screw threaded to receive the respective fastening screws which pass through the flanges 15.

We claim:

1. A mullion section member for fitting between a pair of adjacent roller shutter doors in a door opening, said mullion section member being of a suitable length and having opposed channels at opposite sides each for slidably receiving the edge of the curtain of a respective roller shutter door, a portion bridging the two channels, and behind said portion on the inside face of the mullion section member, flange means which extend the length of the mullion section and define a recess behind said portion in which a plate-like tongue member is slidably received to slide longitudinally of the length of the mullion section member, means fastened to said flange means slidably securing said tongue in said recess at one end of the mullion section member whereby the mullion section can be cut to the required length and said plate-like tongue member located in the correct operative position by said securing means then being secured at the required position on said flange means.

2. A mullion section member assembly for fitting between a pair of adjacent roller shutter doors in a door opening, said mullion section member assembly comprising two substantially identical cross section pieces, one piece being for fixing at the door opening so as to extend downwardly from the top of the opening, the other piece being of a length to fill the space between the bottom of said one piece and the floor of the door opening, the cross section of the mullion pieces having opposed channels at opposite sides each of a size for slidably receiving the edge of a curtain of a respective roller shutter door, a portion bridging the two channels, and behind said portion, on the inside face of the mullion section member, flange means defining a recess between said flange means and said portion, in which a plate-like tongue member can be slidably received to slide in direction along the length of the mullion section member, means fastened to said flange means in said other piece slidably securing said tongue in said recess at the top thereof, locating means extending from the bottom of said other piece, all arranged whereby to enable said other piece to be removably fastened to said one piece and in the position in the door opening by engaging the locating means at the bottom of said other piece with fastening means on the floor and then by sliding the tongue into the corresponding recess in said one piece.

3. The assembly as claimed in claim 2 including a mounting bracket for supporting axles of the adjacent roller shutter doors, said mounting bracket having a plate member slidably received in said recess of said one piece, said plate member having an arm extending therefrom generally perpendicular to the outer face of said mullion for supporting axle bearing means of said axles of the adjacent roller shutter doors, and wherein said plate member is positionable at a correct operative position, to enable said arm to be at a required position for supporting said axles, by sliding to said correct position in said recess and fastening means engaging with said plate member and said flange means to retain said plate member in that position.

4. The assembly as claimed in claim 2 wherein said means which secures said tongue is also received in said recess.

5. The assembly as claimed in claim 4 wherein there is a bolt attached to said tongue member and said means which secures said tongue is of 'TOP HAT' cross section, the bolt being a slidable fit within the central portion of the 'TOP HAT' cross section and the side arms of the cross section extending under said flanges.

6. The assembly as claimed in claim 2 wherein said tongue member has a cut-out at one side edge and in use hidden by the respective flange means at that side edge, said cut-out having a compression spring fitted therein, which co-operates with a shoulder of said cut-out and stop means on said mullion section member to bias said tongue outwardly of the top end of said mullion section member.

7. The assembly as claimed in claim 2 including stop means for engaging with a stop on the edge of a curtain of the respective roller shutter doors and to provide an upper limit stop for the opening of said curtain, said stop means being mounted on a plate member which is slidably received in said recesses of said one piece and wherein said plate member is placed in the correct operative position by sliding said plate member to the required position in said recess and fastening means engaging with said plate member and said flange means to retain said plate member in that position.

* * * * *